US006185760B1

(12) United States Patent
Park

(10) Patent No.: US 6,185,760 B1
(45) Date of Patent: Feb. 13, 2001

(54) LIQUID FLOW CONTROL TAP WITH INEXHAUSTIBLE ENERGY-OPERATED VALVE

(76) Inventor: Yeon-soo Park, 1495 Yongam-dong, Sangdang-dong, Chungju-City, Chungcheongbuk-do (KR)

( * ) Notice: Under 35 U.S.C. 154(b), the term of this patent shall be extended for 0 days.

(21) Appl. No.: 09/194,502

(22) PCT Filed: Oct. 31, 1997

(86) PCT No.: PCT/KR97/00211

§ 371 Date: Nov. 25, 1998

§ 102(e) Date: Nov. 25, 1998

(87) PCT Pub. No.: WO98/40649

PCT Pub. Date: Sep. 17, 1998

(30) Foreign Application Priority Data

Mar. 12, 1997 (KR) ..... 97-9025

(51) Int. Cl.[7] ..... E03C 1/04

(52) U.S. Cl. ..... 4/678; 4/684; 137/391; 137/801

(58) Field of Search ..... 4/675–678, 684, 4/685; 137/391, 398, 801, 428

(56) References Cited

U.S. PATENT DOCUMENTS

| | | | | |
|---|---|---|---|---|
| 3,908,706 | * | 9/1975 | Grewing | 137/428 X |
| 4,607,658 | * | 8/1986 | Fraser et al. | 4/427 X |
| 4,709,427 | * | 12/1987 | Loverty | 4/427 |
| 5,067,517 | * | 11/1991 | Ting-Chih et al. | 137/801 X |

* cited by examiner

*Primary Examiner*—Charles E. Phillips
(74) *Attorney, Agent, or Firm*—Orum & Roth

(57) ABSTRACT

A tap used for controlling the flow of liquid, such as water, oil, or gas, is disclosed. The liquid control tap of this invention has a valve capable of being effectively operated using inexhaustible energy, such as gravity, hydraulic pressure, buoyancy, magnetic force, frictional force, or elasticity. In the tap, a connection pipe, used for the purpose of connecting the tap body to a separate device such as a shower device, is integrated with the rear portion of the tap body into a single structure. The tap is also provided with an eccentric union for controlling the vertical position of the outlet port of the tap. Therefore, the present invention reduces the number of parts, the manufacturing process, improves productivity, and reduces the manufacturing cost of taps.

8 Claims, 18 Drawing Sheets

FIG. 1D
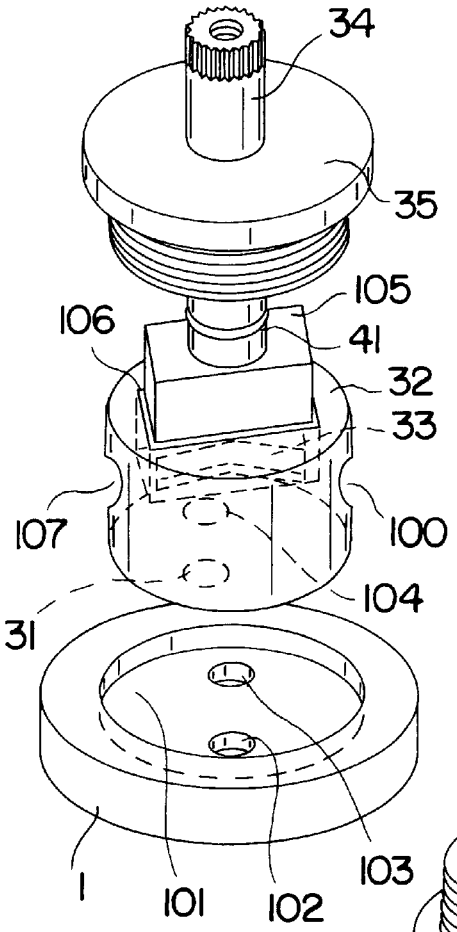
FIG. 1E
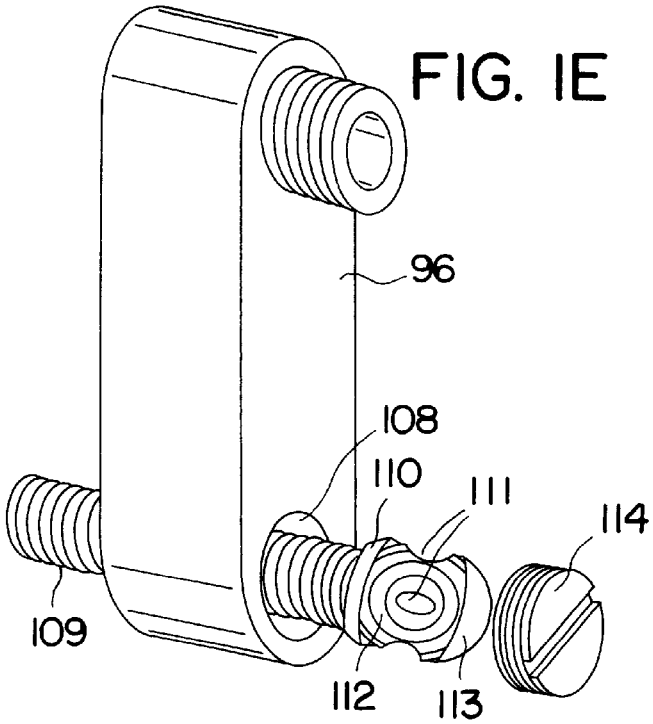
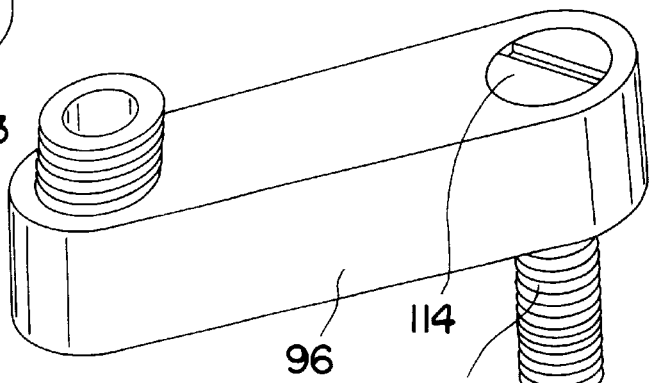
FIG. 1F

LIQUID FLOW CONTROL TAP WITH INEXHAUSTIBLE ENERGY-OPERATED VALVE

TECHNICAL FIELD

The present invention relates, in general, to a tap used for controlling the flow of liquid such as water, oil, or gas and, more particularly, to a tap provided with a valve capable of being effectively operated using inexhaustible energy, such as gravity, hydraulic pressure, buoyancy, magnetic force, frictional force, or elasticity.

BACKGROUND ART

As well known to those skilled in the art, various types of taps used for controlling the flow of liquid such as water, oil, or gas are proposed and widely used. Such taps are individually provided with a valve for selectively opening or closing the liquid passage in a tap. However, such a known tap is not provided with any means for automatically opening or closing the valve and so the valve has to be manually operated and is inconvenient to users. In addition, such a known tap allows a user to lose a considerable amount of liquid regardless of how carefully the user handles the tap, thus overly consuming the liquid. In each of the known taps, the vertical position of a liquid outlet port is fixed. Therefore, such a known tap fails to allow a user to move the vertical position of the outlet port when necessary. Another problem of such taps resides in that they individually have a connector, which is produced separately from a tap body and is attached to the tap body for the purpose of connecting a hose or a rotatable joint for the purpose of connecting a hose or a rotatable joint to the tap body. Such connectors increase the number of parts of the taps and complicate the production process of the taps, thus increasing the manufacturing cost of the taps.

Disclosure of the Invention

Accordingly, the present invention has been made keeping in mind the above problems occurring in the prior art, and an object of the present invention is to provide a liquid flow control tap, of which the valve is effectively operated using inexhaustible energy, such as gravity, hydraulic pressure, buoyancy, magnetic force, frictional force, or elasticity.

BRIEF DESCRIPTION OF THE DRAWINGS

The above and other objects, features and other advantages of the present invention will be more clearly understood from the following detailed description taken in conjunction with the accompanying drawings, in which:

FIG. 1D is an exploded perspective view of a liquid junction part of the tap of this invention, at which hot liquid is mixed with cold liquid;

FIG. 1E is an exploded perspective view of a rotatable eccentric union, which is included in the tap of this invention in order to control the position of the liquid outlet port of the tap;

FIG. 1F is a perspective view of the rotatable eccentric union of FIG. 1E, with the parts of the union being assembled into a single body;

FIG. 3I is a partially broken perspective view showing the operation of the tap according to this invention.

BEST MODE FOR CARRYING OUT THE INVENTION

For ease of description, the tap of this invention will be referred to as a water tap used for controlling the flow of city water. However, it should be understood that the tap of this invention may be preferably used for controlling the flow of another liquid such as oil or gas. In addition, the end of the tap on the right-hand side of the drawings will be referred to as the forward end of the tap and the opposite end on the left-hand side of the drawings will be referred to as the rear end of the tap.

Figure 1A:
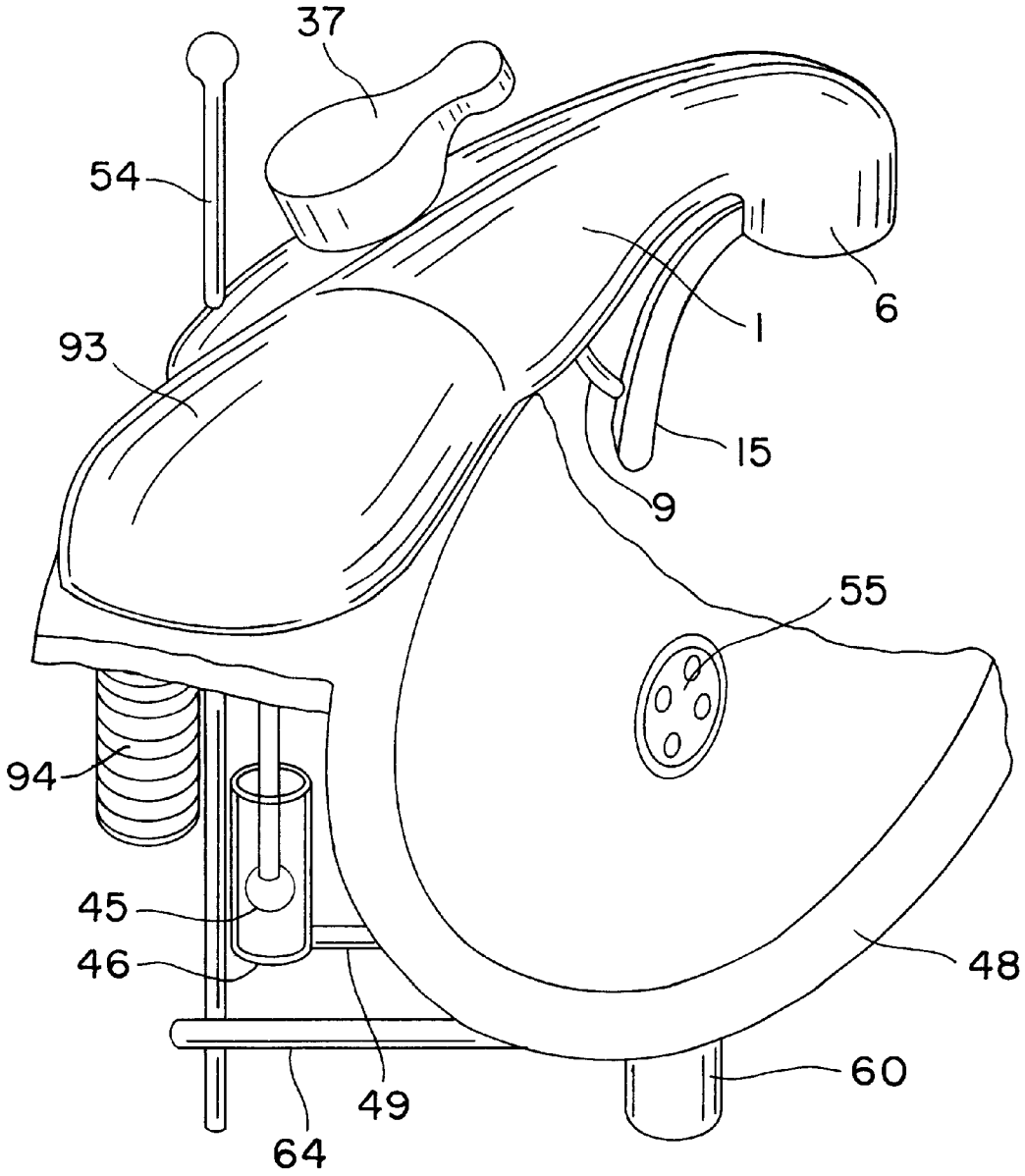
FIG. 1A is a perspective view of a liquid flow control tap suitable for use with a washing stand in accordance with the primary embodiment of this invention.
Figure 2A:
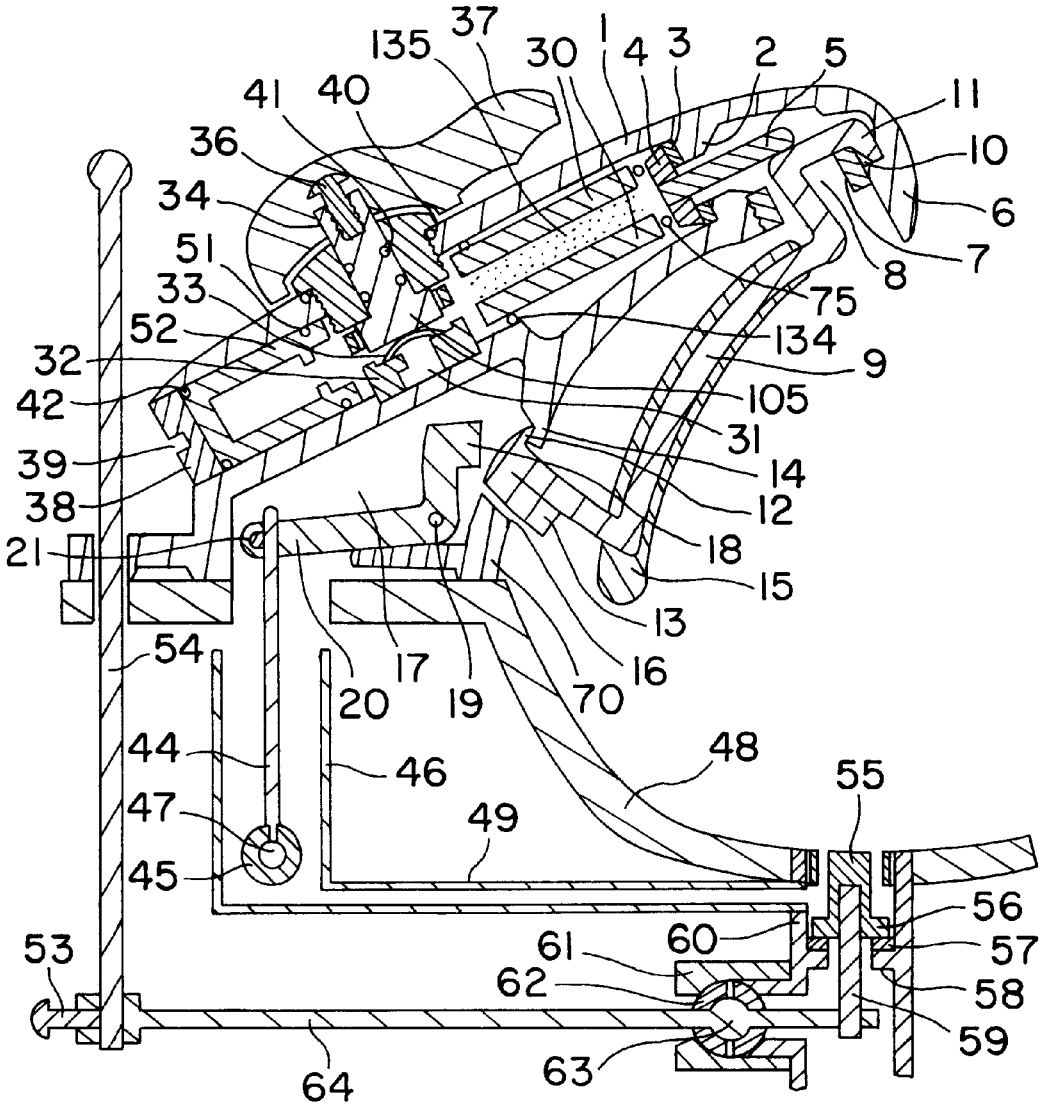
FIG. 2A is a sectional view of the liquid flow control tap of FIG. 1A.

FIGS. 1A and 2A are views showing the construction of a flow control tap suitable for use with a washing stand in accordance with the primary embodiment of this invention. As shown in the drawings, the flow control tap of this invention comprises a tap body 1, which has an outlet port 6 at its front end. A hand lever 9, having handle 15, is assembled with the lower portion of the tap body 1 so as to selectively operate the tap. In order to assemble the lever 9 with the tap body 1, a hook block of the lever 9, comprised of inner and outer hook shoulders 12 and 13, is primarily received into an opening 16 of the tap body 1 prior to inserting the valve operating end 11 of the lever 9 into the inner-threaded outlet port 6 of the tap body 1. Therefore, the inner shoulder 12 of the hook block is caught by a stop shoulder 14 of the tap body 1, while the valve operating end 11 is caught by the stop shoulder 10 of the outlet port 6. Thereafter, an outer-threaded member 7 is brought into engagement with the inner thread of the outlet port 6, thus stably positioning the lever 9 with the handle 15 in the tap body 1.

In addition, a main valve 4 is seated on an annular step 2, which is formed in the water passage provided in the upper portion of the tap body 1. A packing 3 is interposed between the step 2 and the valve 4. The valve stem 5 of the valve 4 extends toward the outlet port 6, thus causing the end of the valve stem 5 to be seated on the valve operating end 11 of the lever 9. A hollow cylindrical magnet 30 is arranged in the water passage of the tap body 1, with one end of the magnet 30 being seated on the valve 4 at a position opposite to the valve stem 5. A coil spring 75 is interposed between the valve 4 and the magnet 30, thus normally biasing the valve 4 onto the annular step 2. The hollow magnet 30 is filled with a known filtering material 135. An O-ring 134 is fitted over the magnet 30, thus sealing the gap between the inside wall of the water passage and the outside wall of the magnet 30 and guiding water into the hollow magnet 30, and making water pass through the filtering material 135 prior to being discharged from the outlet port 6.

A hot and cold water junction member 32, having both a hot water inlet 31 and a cold water inlet 104, is provided in the tap body 1. A rotating shaft 34, having an enlarged-diameter end 105 at its bottom end, is seated in the junction member 32, with a circular-shaped plate spring 33 being interposed between the enlarged-diameter end 105 and the junction member 32, thus normally biasing the junction member 32 downwardly. The rotating shaft 34 also penetrates through a bearing bolt 35 at its middle portion with at least one O-ring 41 being interposed between the shaft 34 and the bolt 35. The bearing bolt 35, with the shaft 34, is brought into engagement with an internal thread, which is provided on the top portion of the tap body 1. In such a case, an O-ring 40 is interposed between the tap body 1 and the bolt 35, thus sealing the gap between the body 1 and the bolt 35.

Due to the plate spring 33, the junction member 32, with the hot and cold water inlets 31 and 104, is normally biased downwardly as described above. Therefore, the bottom surface of the junction member 32 is brought into close contact with a circular depression 101, which is formed in the tap body 1 and is provided with hot and cold water holes 102 and 103 as will be described later herein. The inner-threaded rear end of the tap body 1 is closed by an outer-threaded plug 38, thus defining a horizontal pipe part 120 in the rear portion of the tap body 1. The above plug 38 has a driver groove 39 on its outside surface. An O-ring 42 is interposed between the rear end of the tap body 1 and the plug 38, thus sealing the gap between the body 1 and the plug 38 and forming a water passage in the tap body 1. In the operation of the tap, city water is primarily introduced into the water passage through the hot and cold water holes 102 and 103 of the depression 101 and passes through the hot and cold water inlets 31 and 104 of the junction member 32 prior to being discharged from the tap body 1.

A rotatable handle 37, having a stud bolt 36 at its bottom, is mounted to the top of the rotating shaft 34 at the outside of the tap body 1, with the bolt 36 being threaded into the top of the shaft 34. In the tap body 1, the hot and cold water holes 102 and 103 of the depression 101 and the hot and cold water inlets 31 and 104 of the junction member 32 are arranged on a concentric circle. Therefore, the opening area of each of the hot and cold water holes 102 and 103 is controlled by an associated inlet 31 or 104 of the junction member 32 in accordance with the rotating angle of the handle 37.

The tap body 1 is also provided with a buoyancy-operable lever 20 for selectively pushing the hook block of the hand lever 20 due to buoyancy, thus automatically closing the outlet port 6 when the water bowl 48 is filled with water discharged from the outlet port 6. The above lever 20 has a pushing part 18 at one end thereof and is hinged to the tap body 1 by a pin 19 in the cavity 17, which is formed in the lower portion of the tap body 1 by a shielding member 70. The lever 20 also has a through hole at the other end thereof, thus allowing a push rod 44 of a floating member 45 to be connected to the lever 20. After the push rod 44 is fitted into the through hole of the lever 20, a bolt 21 is screwed to the lever 20, thus detachably connecting the push rod 44 to the lever 20. Due to such a bolt 21, it is possible to control the height of the floating member 45 in a water tank 46.

The above water tank 46 is connected to the discharge pipe 60, provided on the bowl 48 of a washing stand, through a connection pipe 49, thus allowing the floating member 45 to be vertically movable in the tank 46 due to gravity and buoyancy in accordance with the water level in the bowl 48.

An annular seat 58 is interiorly formed in the above discharge pipe 60. A plug member, comprised of upper and lower plugs 55 and 56 integrated into a single structure, is seated on the annular seat 58 with an annular packing 57 being interposed between the lower plug 56 and the annular seat 58. The upper plug 55 is normally positioned in the discharge port of the bowl 48 and has two or more through holes, thus allowing water to normally flow from the bowl 48 into the tank 46 through the connection pipe 49 and making the water levels in the tank 46 and the bowl 48 be equal to each other. Meanwhile, the lower plug 56 is a solid member with a center slot being formed at the bottom surface, thus normally closing the discharge port of the bowl 48 unless the plug member is lifted by a user. In order to manually operate the plug member, a rod 59 is tightly fitted into the center slot of the lower plug 56, thus vertically extending from the lower plug 56 downwardly to a predetermined length. Coupled to the lower end of the above rod 59 is one end of a horizontal longitudinal lever 64. The above lever 64 has a ball part 63 at a position close to the rod 59. The ball part 63 of the lever 63, which is received in an inner-threaded bush 61 through a ball joint, is covered with a rounded packing 62, thus being watertightly sealed in the bush 61. The opposite end of the lever 64 is coupled to the lower end of a vertical push rod 54, which is provided at the outside the tap body 1 and is selectively operated by a user so as to lift the plug member and open the discharge pipe 60. An adjusting bolt 53 is screwed to the end of the lever 64 so as to selectively tighten the push rod 54 in the lever 64, thus allowing the length of the push rod 54 to be manually adjustable.

Figure 1B:
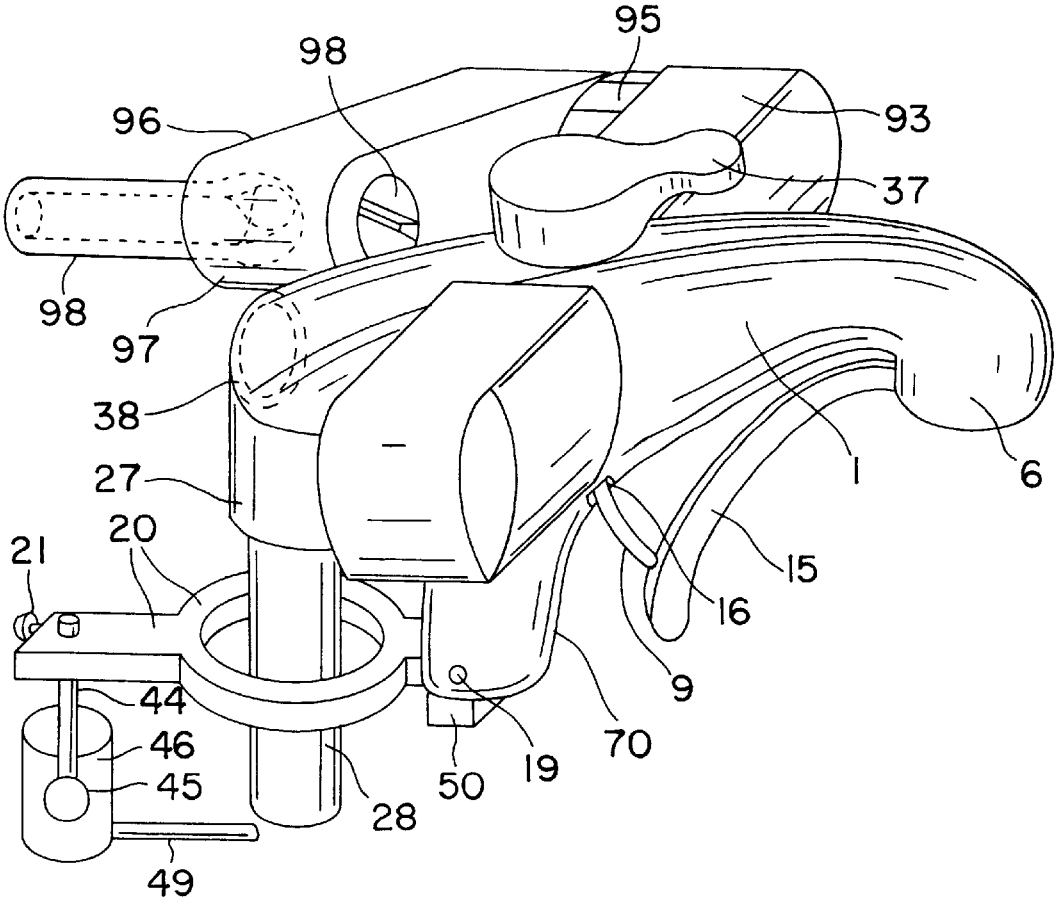
FIG. 1B is a perspective view of a liquid flow control tap suitable for use with a bathtub in accordance with the second embodiment of this invention.
Figure 2B:
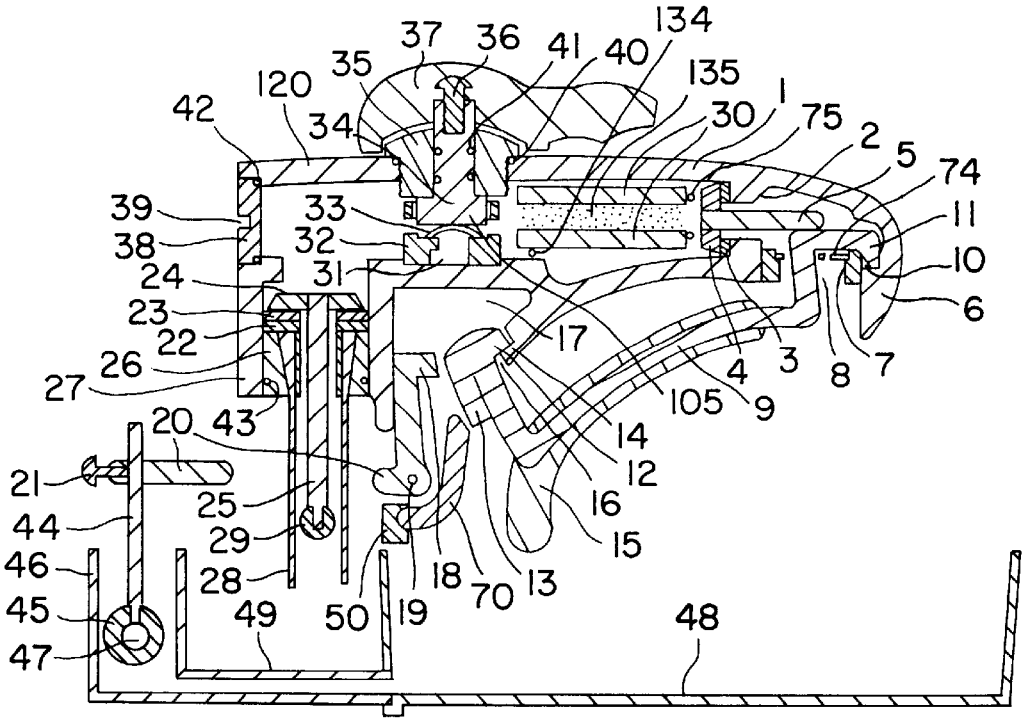
FIG. 2B is a sectional view of the liquid flow control tap of FIG. 1B.

FIGS. 1B and 2B are views showing the construction of a flow control tap suitable for use with a bathtub in accordance with the second embodiment of this invention. In the tap according to the second embodiment, the general shape of the tap body 1 remains the same as in the primary embodiment of FIGS. 1A and 1B and further explanation is thus not deemed necessary, but the tap body 1 additionally has the following structure.

That is, an inner-threaded vertical pipe 27 is formed on the tap body 1 at a position opposite to the outlet port 6 and is interiorly provided with an annular seat 22 at a middle portion thereof. A valve 24, having a valve stem 25, is interiorly seated on the annular seat 22 with an annular packing 23 being interposed between the seat 22 and the valve 24. The valve stem 25 passes downwardly through both the annular packing 23 and the annular seat 22. Thereafter, a hollow set bolt 26, holding a vertical hose 28, is screwed upwardly into the inner-threaded pipe of the tap body 1, with the top end of the bolt 26 coming into close contact with the bottom surface of the annular seat 22. An O-ring 43 is interposed between the bolt 26 and the inner-threaded vertical pipe 27. The vertical hose 28 is tightly fitted into the set bolt 26, with the lower portion of the hose 28 completely surrounding the valve stem 25. A first magnet 29 is mounted to the lower end of the valve stem 25, while a second magnet 50 is mounted to the lower end of the shielding member 70. The two magnets 29 and 50 are appropriately positioned so as to selectively and magnetically attract each other.

In the second embodiment, the configuration of the buoyancy-operable lever 20 is altered to allow the hose 28 to pass through the middle portion of the lever 20. That is, the lever 20 has an annular part at its middle portion and allows the hose 28 to pass through. The other end of the lever 20 extends to the outside of the tap body 1 different from the primary embodiment and is connected to a push rod 44 using an adjusting bolt 21. The lower end of the push rod 44 is provided with a floating member 45, which is received in a water tank 46.

The above water tank 46 is connected to a bathtub 48 through a connection pipe 49, thus having the same water level as that of the bathtub 48. Therefore, the floating member 45 in the tank 46 is selectively lifted or lowered due to buoyancy or gravity in accordance with the water level in the bathtub 48 and operates the lever 20.

Figure 1C:
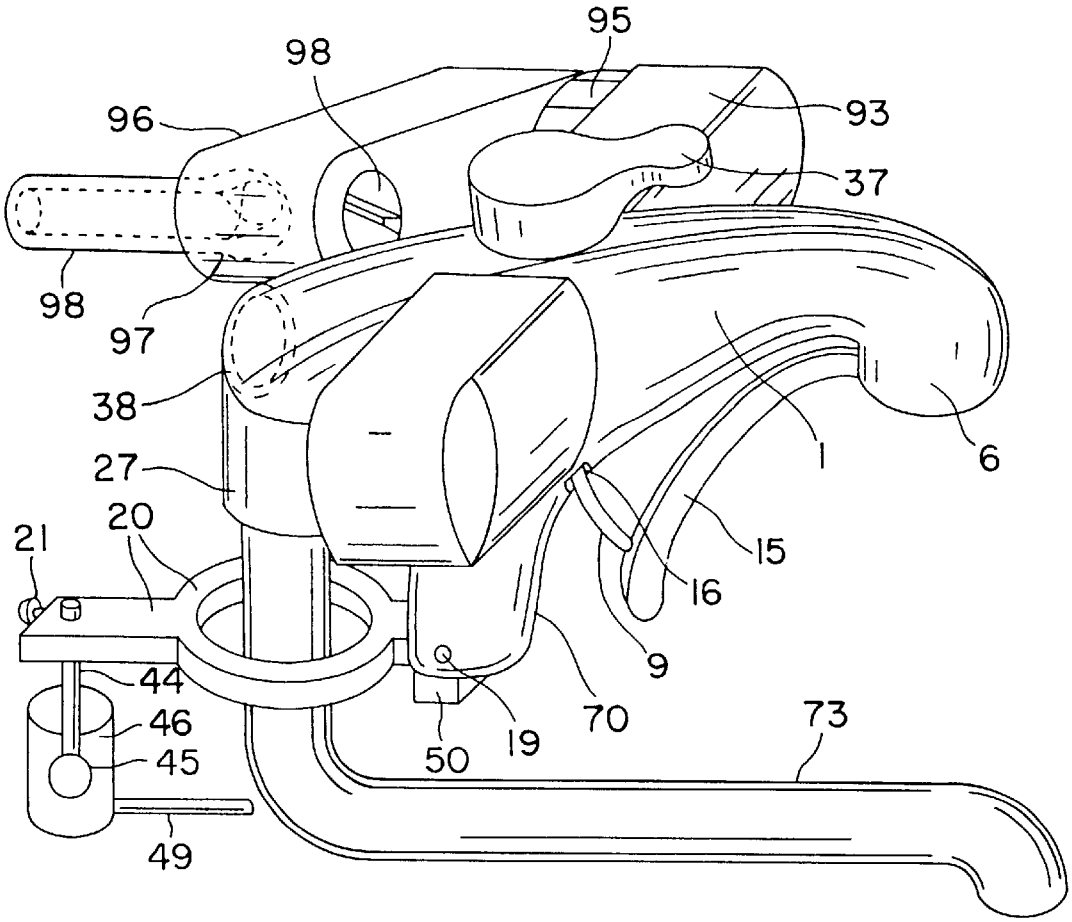
FIG. 1C is a perspective view of a liquid flow control tap suitable for use with a kitchen sink in accordance with the third embodiment of this invention.
Figure 2C:
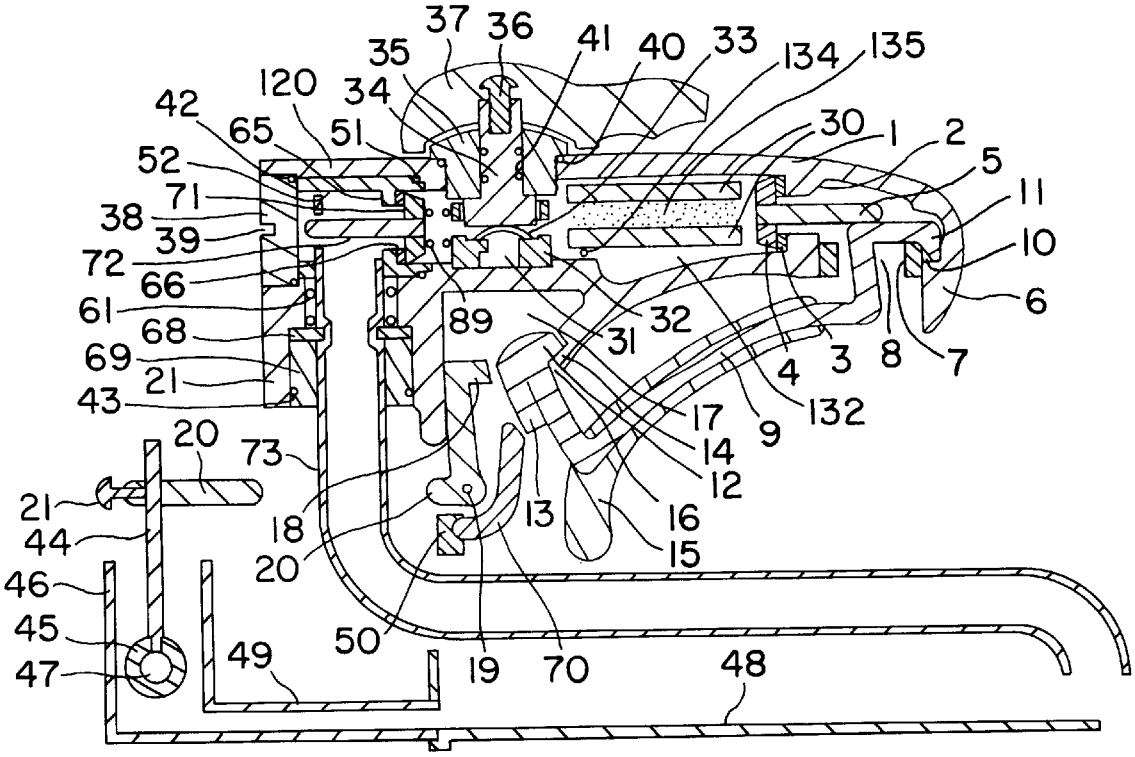
FIG. 2C is a sectional view of the liquid flow control tap of FIG. 1C.

FIGS. 1C and 2C show the construction of a flow control tap suitable for use with a kitchen sink in accordance with the third embodiment of this invention. In the third embodiment, the general shape of the tap body 1 remains the same as in the second embodiment of FIGS. 1B and 2B and further explanation is thus not deemed necessary, but the rear and lower portions of the tap body 1 is altered as follows. That is, a horizontal pipe part 120 is formed in the rear portion of the tap body 1, while a valve housing 52, having an interior annular seat 65, is horizontally installed in the horizontal pipe part 120. An annular packing 51 is interposed between the valve housing 52 and the pipe part 120. A valve 71, having a valve stem 72, is seated on the annular seat 65 with the valve stem 72 axially extending through the valve housing 52. A packing 66 is interposed between the annular seat 65 and the valve 71. The inner-threaded rear end of the tap body 1 is closed by an outer-threaded plug 38 with an O-ring 42 being interposed between the tap body 1 and the plug 38. The plug 38 has a driver groove 39 on its outside surface.

A rotatable liquid discharge pipe 73, having a bent configuration with both a vertical portion and a horizontal portion, is rotatably fitted into the vertical pipe 27 of the tap body 1 at the vertical portion. The top end of the vertical portion of the rotatable pipe 73 has a U-shaped vertical slit. In order to connect the rotatable pipe 73 to the vertical pipe 27, a set bolt 69 is fitted over the vertical portion of the rotatable pipe 73. In addition, a coupling ring 68 is fitted over an annular groove of the pipe 73. In such a case, the set bolt 69 is positioned under the coupling ring 68. Thereafter, the set bolt 69 is upwardly screwed into the inner-threaded vertical pipe 27, with the valve stem 72 engaging with the U-shaped slit of the rotatable pipe 73. A first O-ring 43 is interposed between the set bolt 69 and the vertical pipe 27, while a second O-ring 67 is interposed between the rotatable pipe 73 and the vertical pipe 27 at a position above the coupling ring 68.

In the tap of FIGS. 1C and 2C, the configuration of the buoyancy-operable lever 20 is altered to allow the vertical portion of the pipe 73 to pass through the middle portion of the lever 20 in the same manner as that described for the second embodiment. That is, the lever 20 has an annular part at its middle portion and allows the pipe 73 to pass through. The above tap is preferably installed on a kitchen sink 48 with the rotatable pipe 73 horizontally extending under the tap body 1. The above pipe 73 is freely and manually rotatable in opposite directions and selectively discharges water into the kitchen sink 48 when the valve 71 is opened. On the other hand, the water tank 46, which receives the floating member 45, is communicates with the sink 48 through a connection pipe 49, thus having the same water level as that of the sink 48. Therefore, the floating member 45 is selectively lifted or lowered due to buoyancy or gravity in accordance with the water level in the sink 48 and selectively operates the lever 20.

Figure 2D:
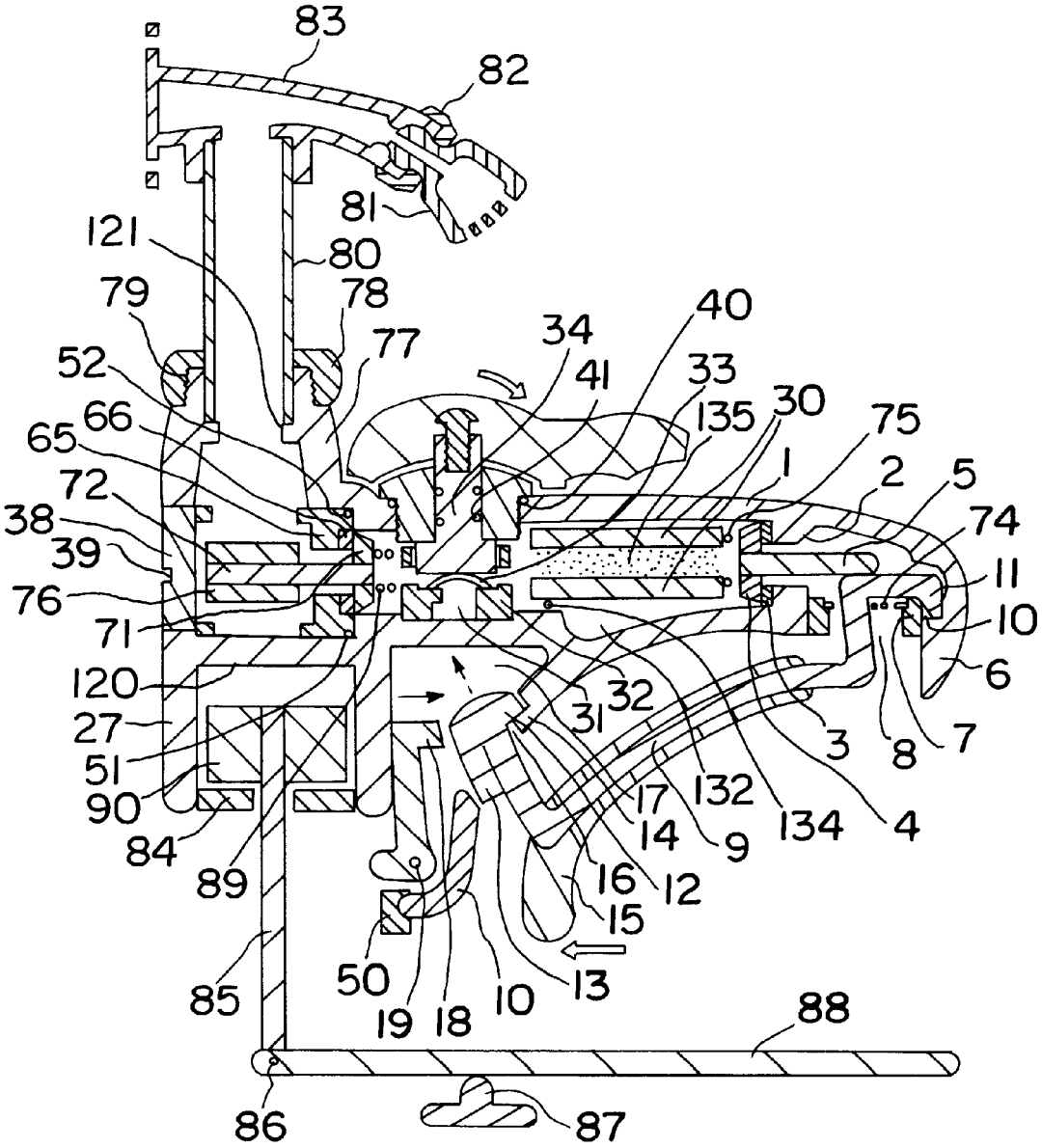
FIG. 2D is a sectional view of a liquid flow control tap suitable for use with a shower device according to an embodiment of this invention.

FIG. 2D shows the construction of a flow control tap suitable for use with a shower device in accordance with an embodiment of this invention. In this embodiment, the general shape of the tap remains the same as in the embodiment of FIG. 2C, but the rear port of the tap body 1 is altered as follows. That is, a valve housing 52, having an interior annular seat 65, is horizontally installed in a horizontal pipe part 120, which is formed in the rear portion of the tap body 1. An annular packing 51 is interposed between the valve housing 52 and the pipe part 120. A valve 71, having a valve stem 72, is seated on the annular seat 65 with the valve stem 72 axially extending through the valve housing 52. The valve 71 is normally biased to the rear end of the tap body 1 by a coil spring 89. In addition, a packing 66 is interposed between the annular seat 65 and the valve 71. The inner-threaded rear end of the tap body 1 is closed by an outer-threaded plug 38, with an O-ring 42 being interposed between the tap body 1 and the plug 38. The plug 38 has a driver groove 39 on its outside surface. In order to selectively operate the valve 71, the tap body 1 has a cooperation means for operating the valve 71. In the embodiment of FIG. 2D, the cooperation means comprises a cylindrical magnet 76, which is fitted over the rear end of the valve stem 72 in the valve housing 52.

In addition, a push rod 85,. having a magnet 90 at its top end, is upwardly inserted into the lower vertical pipe 27 of the tap body 1, with the magnet 90 being movably positioned in the vertical pipe 27. After the magnet 90 is received in the vertical pipe 27, the lower end of the pipe 27 is closed by a plug 84, thus preventing the magnet 90 from being unexpectedly removed from the vertical pipe 27. The two magnets 76 and 90 are arranged so as to magnetically attract each other.

An upper vertical pipe 77 is formed on the tap body 1 at a position above the horizontal pipe part 120 and has an interior annular seat 121. A connection pipe 80, which is used for the purpose of connecting the tap body 1 to a separate device such as a shower device, is vertically fitted into the upper vertical pipe 77 with the lower end of the pipe 80 being seated on the annular seat 121. After fitting the pipe 80 into the vertical pipe 77, a cap nut 78 is screwed onto the outer-threaded top end of the vertical pipe 77, thus fixing the position of the pipe 80 in the tap. An O-ring 79 is interposed between the top end of the vertical pipe 77 and the cap nut 78. A shower device 83 is connected to the top end of the pipe 80 through a conventional manner. A faucet head 81 is mounted to the tip of the shower device 83 using a cap nut 82.

The lower end of the push rod 85 is hinged to one end of a foot lever 88 through a pin 86. A fulcrum 87 is put under the foot lever 88.

Figure 2E:
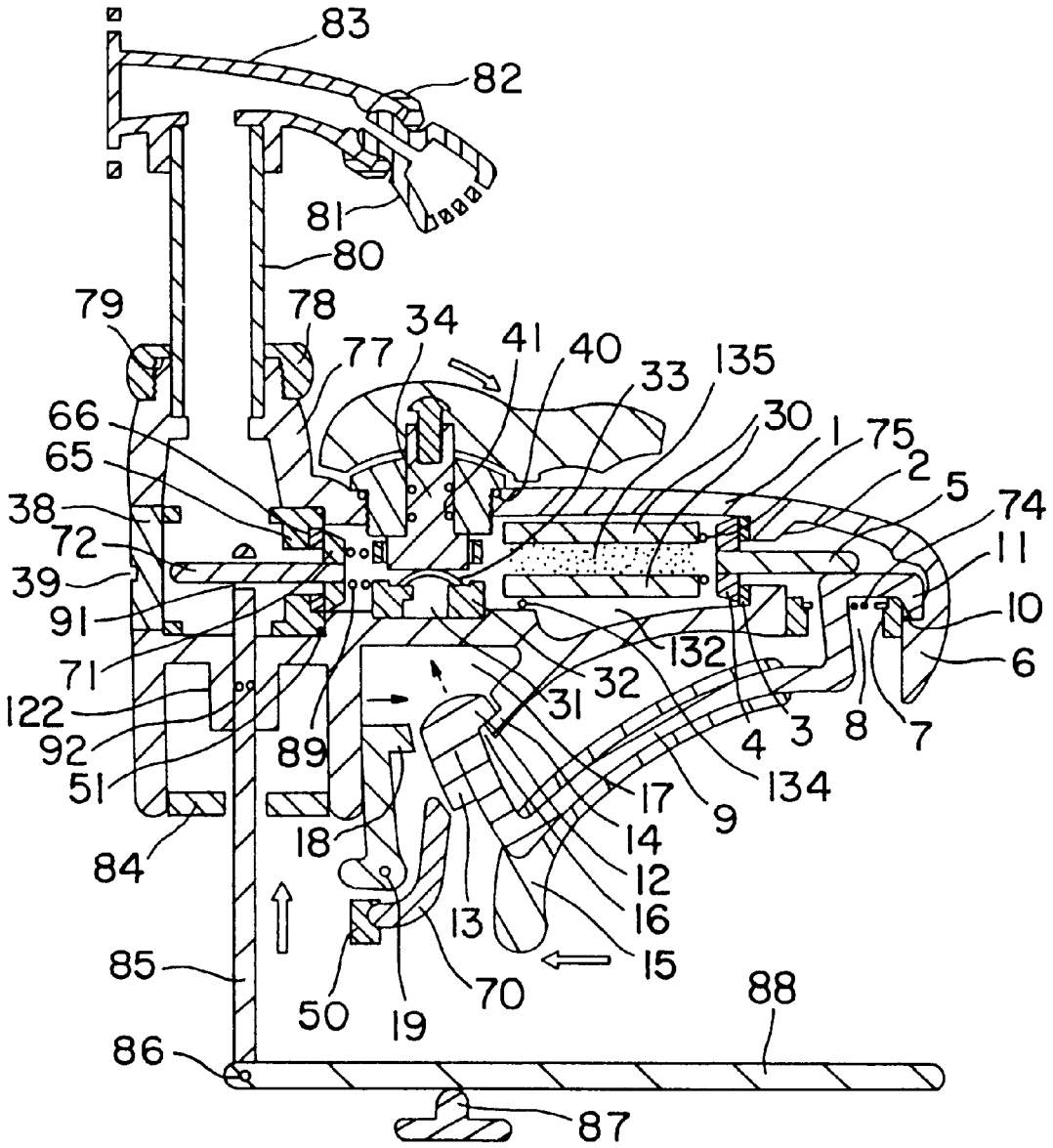
FIG. 2E is a sectional view of a liquid flow control tap suitable for use with a shower device according to another embodiment of this invention.

FIG. 2E shows the construction of a flow control tap suitable for use with a shower faucet in accordance with another embodiment of this invention. In this embodiment, the general shape of the tap remains the same as in the embodiment of FIG. 2D and further explanation is thus not deemed necessary , but the cooperation means is altered as follows. That is, the two magnets 76 and 90 are removed from the tap body 1. Instead of the two magnets 76 and 90, a push rod 85 is inserted into an internal pipe 122 of the lower vertical pipe part 27 with an O-ring 92 being interposed between the rod 85 and the internal pipe 122. The top end of the push rod 85 has a transverse slot 91 at which the valve stem 72 is connected to the push rod 85.

Figure 1G:
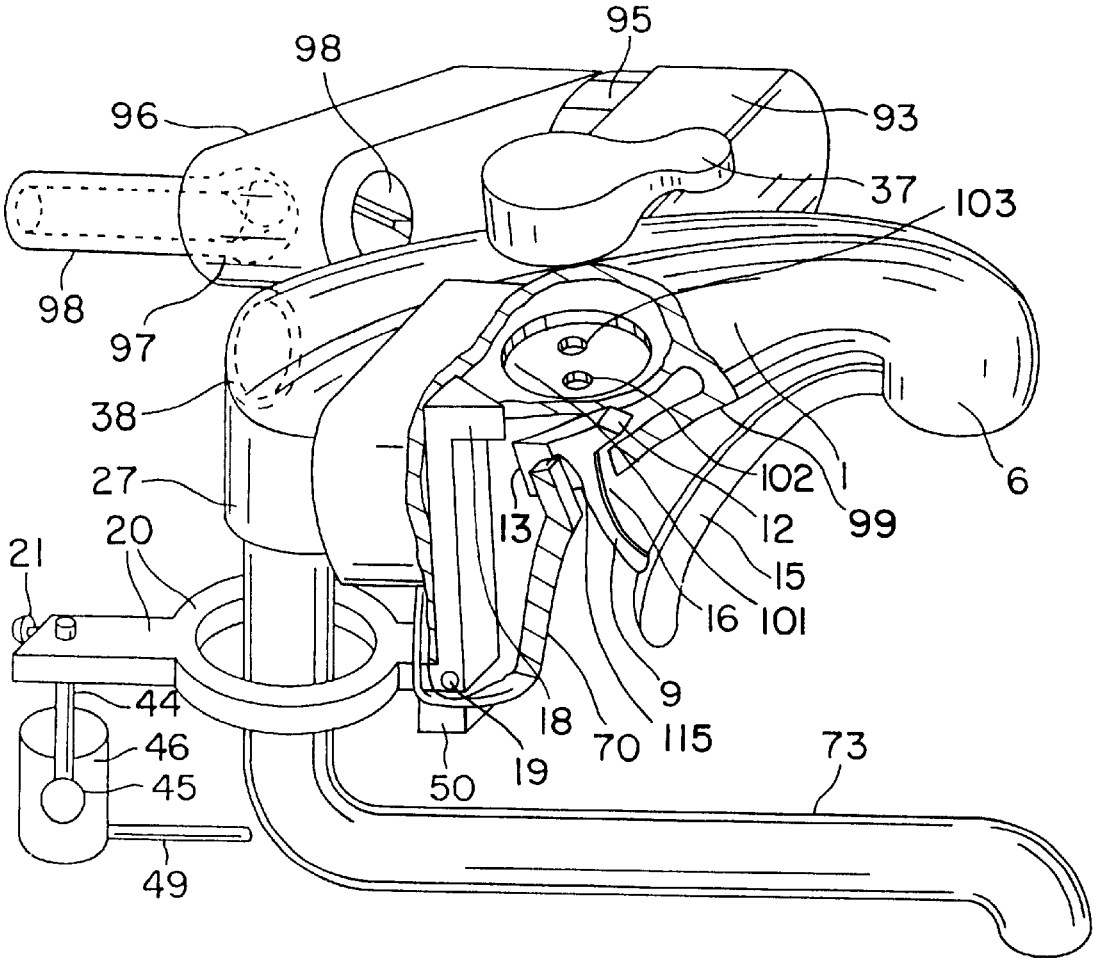
FIG. 1G is a partially broken perspective view of the tap of this invention.
Figure 2G:
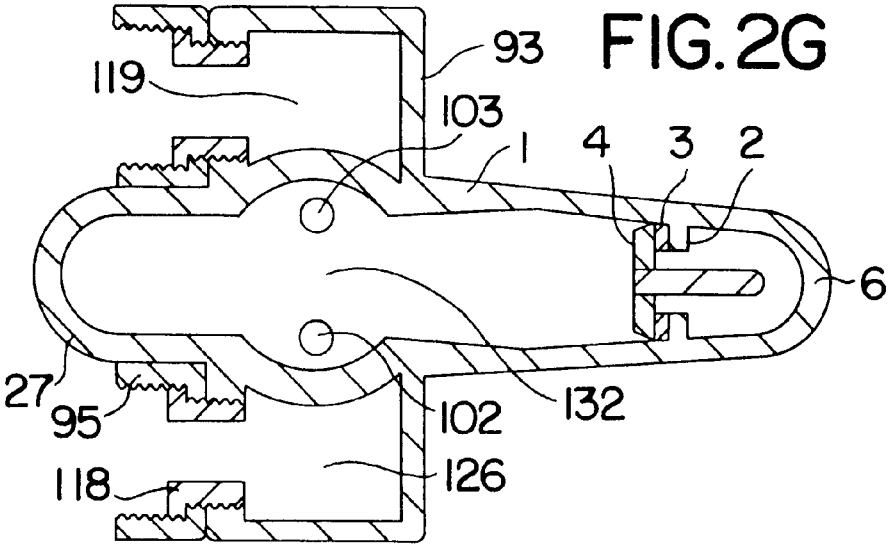
FIG. 2G is a sectional view of the tap of this invention.
Figure 2H:
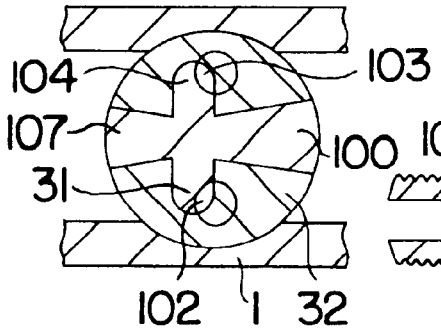
FIG. 2H is a sectional view of the liquid junction part of the tap according to this invention.
Figure 2F:
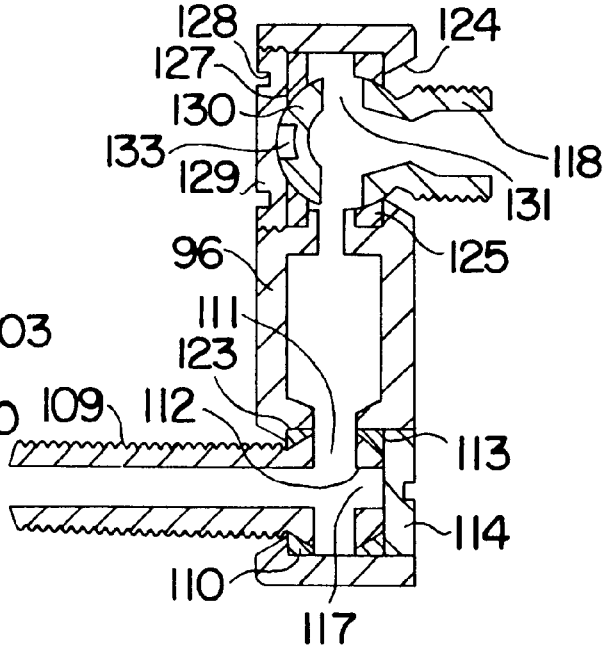
FIG. 2F is a sectional view of the rotatable eccentric union of this invention.

FIGS. 1E, 1F and 2F show the construction of a rotatable eccentric union, which is provided at a side of the tap body 1 so as to control the vertical position of the outlet port 6. As shown in the drawings, the union 96 has an inlet port 123 at its lower end and is connected to a first water supply pipe 109 at the inlet port 123 through a ball joint. One end of the pipe 109 forms a ball part 112, which has a plurality of discharge ports 111 and hexagonal ports 117. The ball part 112 is movably received in the inlet port 123 of the union 96, thus forming the ball joint between the water supply pipe 109 and the union 96. A packing 110 is interposed between the ball part 112 and the inlet port 123. After the ball part 112 is received in the inlet 123, the inlet port 123 is closed by a plug 114 with a packing 113 being interposed between the inlet port 123 and the plug 114. Meanwhile, the top end of the union 96 forms an outlet port 124 and is connected to a second water supply pipe 118 at the outlet port 124 through a ball joint. One end of the pipe 124 forms a ball part 130, which has a plurality of discharge ports 131 and hexagonal ports 133. The ball part 130 is movably received in the outlet port 124 of the union 96, thus forming the ball joint between the second water supply pipe 118 and the union 96. A packing 125 is interposed between the ball part 130 and the outlet port 124. After the ball part 130 is received in the outlet port 124, the outlet port 124 is closed by a plug 129 with a packing 127 being interposed between the outlet port 124 and the plug 129. In the same manner as that described for the plug 114 provided at the lower end of the union 96, the plug 129 has a driver groove 128. The position of the above eccentric union 96 relative to the tap body 1 is referred to FIGS. 1B, 1C, 1G and 2C.

As shown in FIG. 2G, the tap body 1 has a cold water cavity 119, which is connected to the mixing cavity 132 through the cold water hole 103. The tap body 1 also has a hot water cavity 126, which is connected to the mixing cavity 132 through the hot water hole 102. Cold water is discharged from the cold water cavity 119 into the mixing cavity 132 through the cold water hole 103, while hot water is discharged from the hot water cavity 126 into the mixing cavity 132 through the hot water hole 102. In the mixing cavity 132, cold water is mixed with hot water prior to being discharged from the cavity 132 through either the outlet port 6 or the vertical pipe 27.

As best seen in FIG. 2H, the junction member 32, with discharge ports 100 and 107 and the hot and cold water inlets 31 and 104, is normally biased downwardly by the spring 33 and so the bottom surface of the junction member 32 is brought into close contact with the circular depression 101 having the hot and cold water holes 102 and 103. In such a case, the hot and cold water holes 102 and 103 of the depression 101 and the hot and cold water inlets 31 and 104 of the junction member 32 are arranged on a concentric circle. The center of each of the two holes 102 and 103 is positioned on the diameter of the concentric circle. The distance between the two holes 102 and 103 is longer than that of the two inlets 31 and 104, thus allowing the amount of hot water to be equal to that of cold water when the handle 37 is rotated to its neutral position.

As shown in FIG. 1G, the outer shoulder 13 of the lever 9 is wide at its right-hand surface and is narrow at its left-hand surface, thus being tapered. In the same manner, the pushing part 18 of the lever 20 is narrow at its right-hand surface and is wide at its left-hand surface, thus being tapered.

The operational effect of the above water tap will be described hereinbelow with reference to FIGS. 3A to 3I. Of course, it should be understood that the tap of this invention may be preferably used for controlling the flow of another liquid such as oil or gas in place of water without affecting the operational effect of the tap.

Figure 3A:
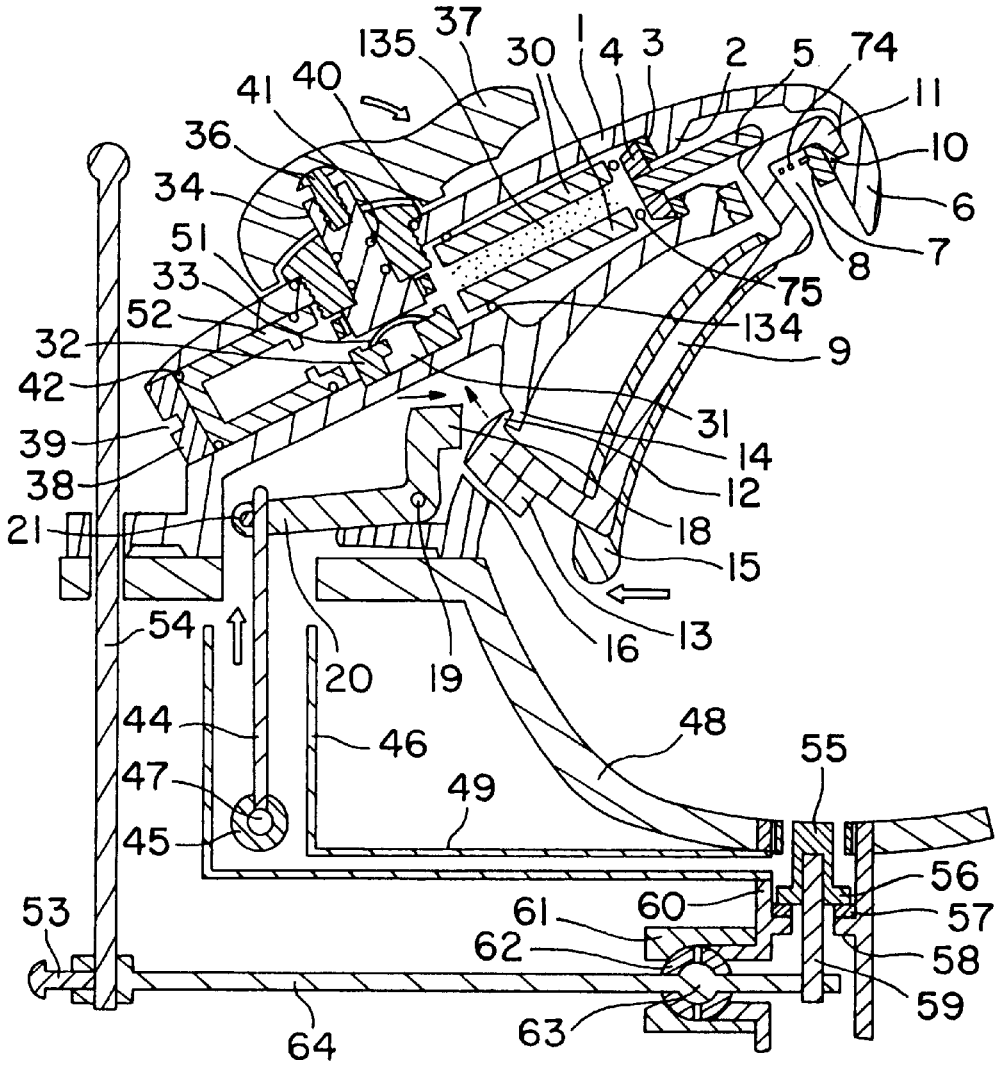
FIG. 3A is a sectional view showing the operation of the tap of FIGS. 1A and 1B.

FIGS. 3A and 3I show the operation of the tap of this invention used with a washing stand 48.

When the handle 15 of the tap is primarily pushed back as shown by the arrow in FIGS. 3A and 3I, the lever 9 is moved clockwise around the valve operating end 11 of the lever 9, thus lifting the valve stem 5 and opening the valve 4. Therefore, water is discharged from the tap through the outlet port 6.

When the pushing force is removed from the above handle 15, the parts of the tap are automatically returned to their original positions due to inexhaustible natural energy, such as gravity, hydraulic pressure, frictional force and elasticity. Therefore, the outlet port 6 is automatically closed.

Meanwhile, when the primarily pushed handle 15 of FIGS. 3A and 3I is further pushed in the same direction, the outer shoulder 13 is caught by the stopper 115, thus allowing the opened position of the valve 4 to be continued even when the pushing force is completely removed from the handle 15. Therefore, water is continuously discharged from the outlet port 6.

On the other hand, when the handle 15 in the above state is manually pulled forward, the outer shoulder 13 is forcibly separated from the stopper 115, thus allowing the parts of the tap to be returned to their original positions due to inexhaustible natural energy, such as gravity, hydraulic pressure, frictional force and elasticity. Therefore, the outlet port 6 is automatically closed.

When the handle 15 is fully pushed back and is stopped at a position with the outer shoulder 13 being caught by the stopper 115 as described above, the water level in the bowl 48 is raised and makes water continuously flow into the tank 46 through the connection pipe 49, thus raising the water level in the tank 46. Therefore, the floating member 45 in the tank 46 is lifted due to buoyancy as shown by the arrow of FIG. 3A and rotates the lever 20 clockwise using its push rod 44.

When the lever 20 is rotated clockwise as described above, the pushing part 18 of the lever 20 is moved to the front as shown by the arrow of FIG. 3A, thus pushing the shoulder 13 of the lever 9 to the front. Therefore, the shoulder 13 is automatically removed from the stopper 115, thus allowing the parts of the tap to be returned to their original positions and closing the outlet port 6.

In the operation of the above tap, water passes through the magnet 30, filled with the filtering material 135, prior to being discharged from the outlet port 6. Therefore, the water is effectively magnetized, filtered and purified.

When the vertical push rod 54 is pushed downwardly so as to empty the bowl 48, the plugs 55 and 56 are lifted, thus opening the discharge port of the bowl 48 allowing water to be discharged from both the tank 46 and the bowl 48 through the discharge pipe 60. In such a case, the floating member 45 is automatically lowered and allows the parts of the tap to be returned to their original positions.

In the operation of the above tap, the temperature of water discharged from the tap is controlled as follows.

Figure 3B:
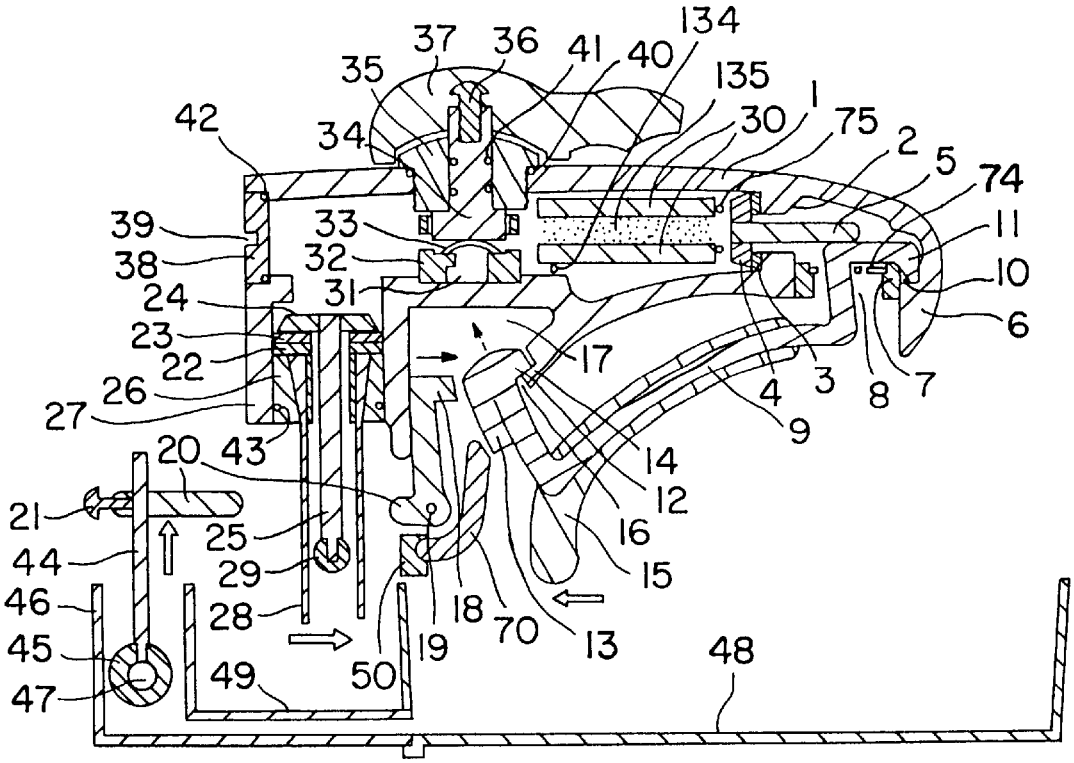
FIG. 3B is a sectional view showing the operation of the tap of FIGS. 1B and 2B.
Figure 3C:
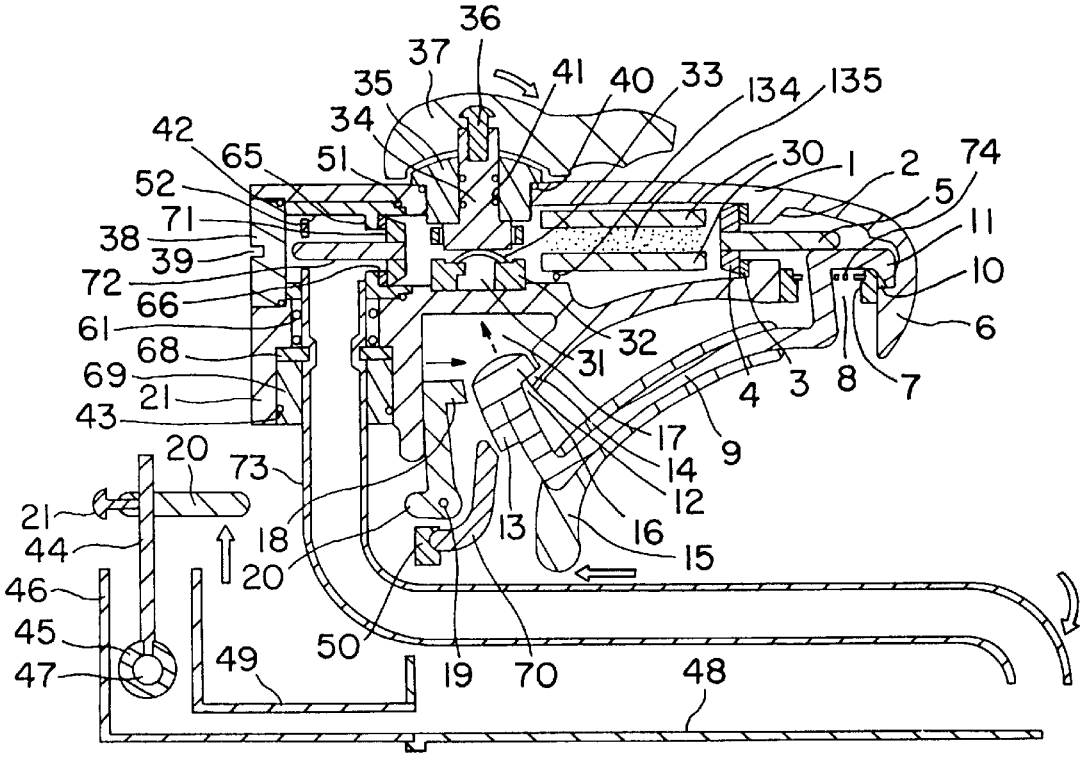
FIG. 3C is a sectional view showing the operation of the tap of FIGS. 1C and 2C.
Figure 3D:
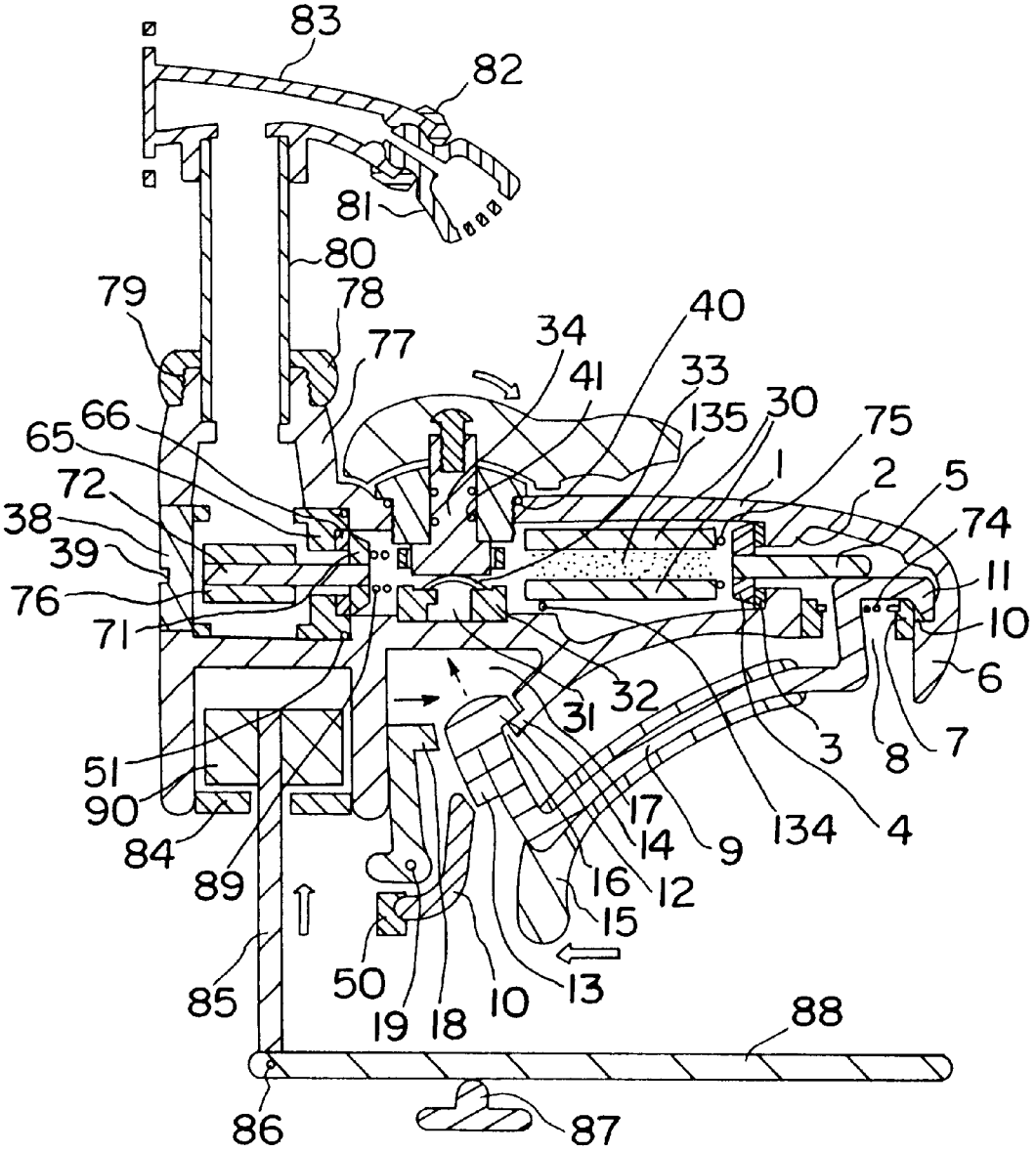
FIG. 3D is a sectional view showing the operation of the tap of FIG. 2D.
Figure 3E:
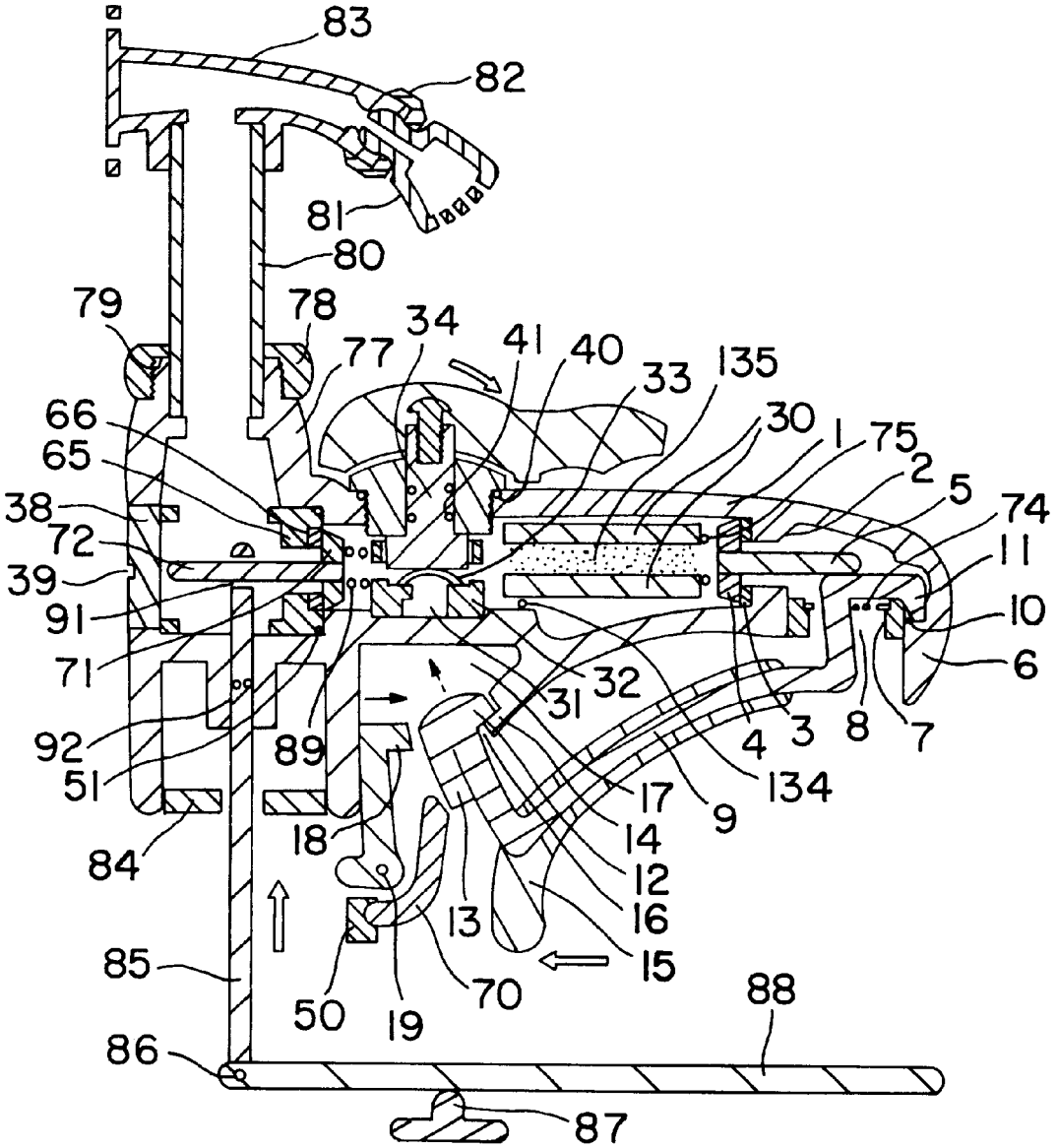
FIG. 3E is a sectional view showing the operation of the tap of FIG. 2E.
Figure 3G:
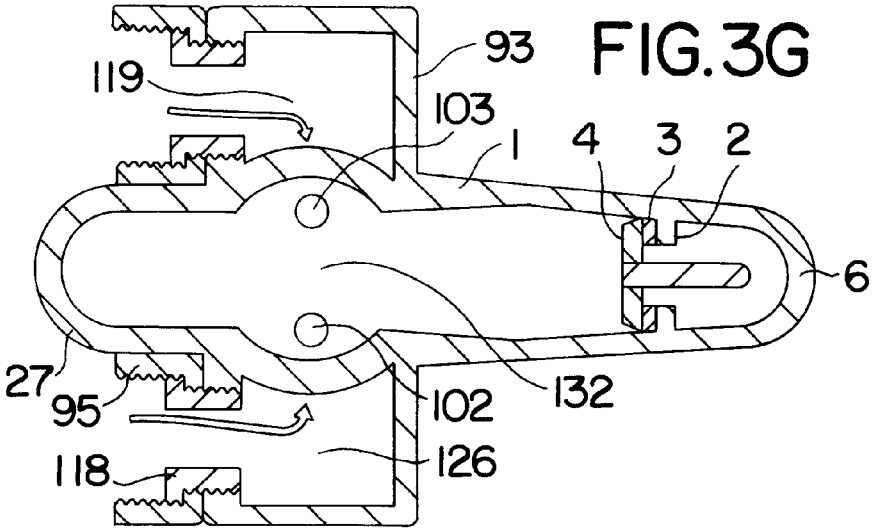
FIG. 3G is a sectional view showing the flow passage of hot and cold liquid in the tap of this invention.
Figure 3H:
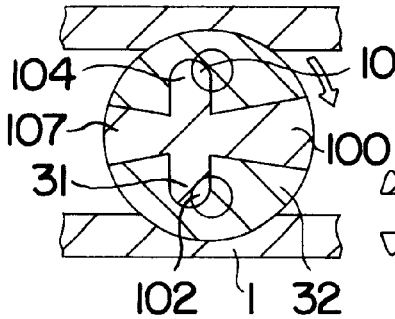
FIG. 3H is a sectional view showing the operation of the liquid junction part included in the tap of this invention.

When the handle 37 is rotated to its neutral position as shown in FIG. 3A, the cold water hole 103 is half opened by the cold water inlet 104, while the hot water hole 102 is half opened by the hot water inlet 31 as shown in FIGS. 3G and 3H. In such a case, cold water is introduced from the cavity 119 into the cold water hole 103, while hot water is introduced from the cavity 126 into the hot water hole 102. The cold water is mixed with the hot water into warm water at the discharge ports 100 and 107 of the junction member 32.

Meanwhile, when the handle 37 is rotated clockwise, the opening area of the cold water hole 103 is gradually enlarged by the cold water inlet 104. However, the opening area of the hot water hole 102 is gradually reduced by the hot water inlet 31. Therefore, the amount of cold water passing through the cold water hole 103 is more than that of hot water passing through the hot water hole 102, thus causing the mixed water at the discharge ports 100 and 107 of the junction member 32 to have a low temperature. On the other hand, when the handle 37 is rotated counterclockwise, the opening area of the cold water hole 103 is gradually reduced by the cold water inlet 104, while the opening area of the hot water hole 102 is gradually enlarged by the hot water inlet 31. Therefore, the amount of hot water passing through the hot water hole 102 is more than that of cold water passing through the cold water hole 103, thus causing the mixed water at the discharge ports 100 and 107 to have a high temperature.

FIG. 3B shows the operation of the tap of this invention used with a bathtub 48.

The operational theory of the tap of FIG. 3B is equal to that described for the embodiment of FIGS. 3A, 3G, 3H and 3I and further explanation for the operational theory is thus not deemed necessary. The tap of FIG. 3B is operated as follows.

When the vertical hose 28 is primarily pulled to the front as shown by the arrow of FIG. 3B, both the magnet 29 and the valve stem 25 are leaned to the same direction, thus opening the valve 24 and allowing water to be discharged from the hose 28.

When the pulling force is removed from the above hose 28, both the magnet 29 and the valve stem 25 are returned to their original positions due to gravity and hydraulic pressure, thus automatically closing the valve 24 and stopping the discharge of water.

However, when the primarily pulled hose 28 is further pulled in the same direction, both the magnet 29 and the valve stem 25 are further leaned to the same direction and so the magnet 29 magnetically attracts the other magnet 50. Therefore, the opened position of the valve 24 is continued and allows water to be discharged from the hose 28.

When the pulling force is removed from the above hose 28, the magnet 29 is continuously stuck to the other magnet 50, thereby allowing water to be continuously discharged from the hose 28 regardless of the pulling force being removed from the hose 28.

In order to stop the discharge of water, it is necessary to swing the hose 28 when the pulling force is removed from the hose 28. In such a case, the magnet 29 is effectively separated from the magnet 50. Therefore, the parts of the tap are returned to their original positions due to gravity and hydraulic pressure, thus automatically closing the valve 24 and stopping the discharge of water.

The tap of FIG. 3B may be used with a shower device being connected to the lower end of the hose 28. In such a case, the tap starts to discharge water from the hose 28 with the shower device being pulled and stops the discharge of water with the pulling force being removed from the shower device.

FIG. 3C shows the operation of the tap of this invention used with a kitchen sink 48.

The operational theory of the tap of FIG. 3C is equal to that described for the embodiment of FIGS. 3A, 3G, 3H and 3I and further explanation for the operational theory is thus not deemed necessary. The tap of FIG. 3C is operated as follows.

When the rotatable liquid discharge pipe 73 is rotated in a direction so as to move the valve stem 72 clockwise, the valve 71 is opened and allows water to be discharged from the pipe 73.

Meanwhile, when the rotatable pipe 73 is rotated in the opposite direction so as to move the valve stem 72 counterclockwise, the valve 71 is closed and stops the discharge of water.

FIG. 3D shows the operation of the tap of FIG. 2D, used with a shower device.

The operational theory of the tap of FIG. 3D is equal to that described for the embodiment of FIGS. 3A, 3G, 3H and 3I and further explanation for the operational theory is thus not deemed necessary. The tap of FIG. 3D is operated as follows.

When a user presses the foot lever 88 with his foot, the push rod 85 is lifted, thus moving the magnet 90 upwardly as shown by the arrow of FIG. 3D. Therefore, the two magnets 76 and 90 magnetically attract each other, thus opening the valve 71 and allowing water to pass through both the pipe 80 and the shower device 83 prior to being discharged from the faucet head 81. On the other hand, when the pressing force is removed from the lever 88, the parts of the tap are returned to their original positions, thus closing the valve 71 and stopping the discharge of water.

FIG. 3E shows the operation of the tap of FIG. 2E, used with a shower device.

The operational theory of the tap of FIG. 3E is equal to that described for the embodiment of FIGS. 3A, 3G, 3H and 3I and further explanation for the operational theory is thus not deemed necessary. The tap of FIG. 3E is operated as follows.

When a user presses the foot lever 88 with his foot, the push rod 85 is lifted, thus moving the valve stem 72 upwardly as shown by the arrow of FIG. 3E. Therefore, the valve 71 is opened, thus allowing water to pass through both the pipe 80 and the shower device 83 prior to being discharged from the head 81. When the pressing force is removed from the lever 88, the parts of the tap are returned to their original positions, thus closing the valve 71 and stopping the discharge of water.

Figure 3F:
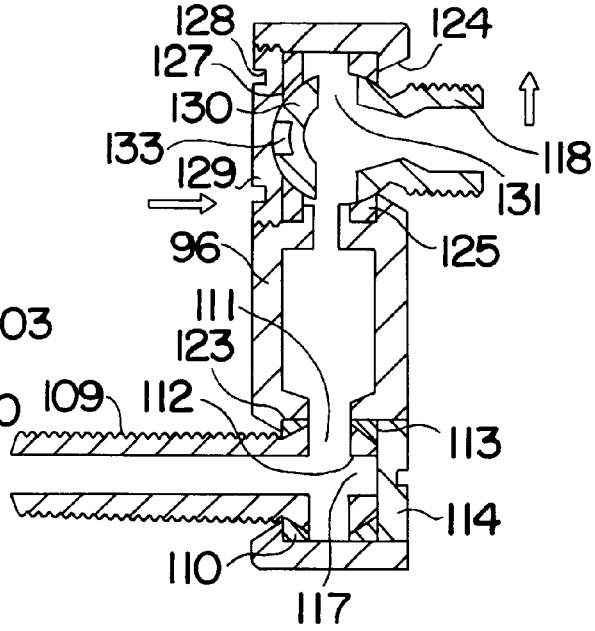
FIG. 3F is a sectional view showing the operation of the rotatable eccentric union of this invention.
Figure 31:
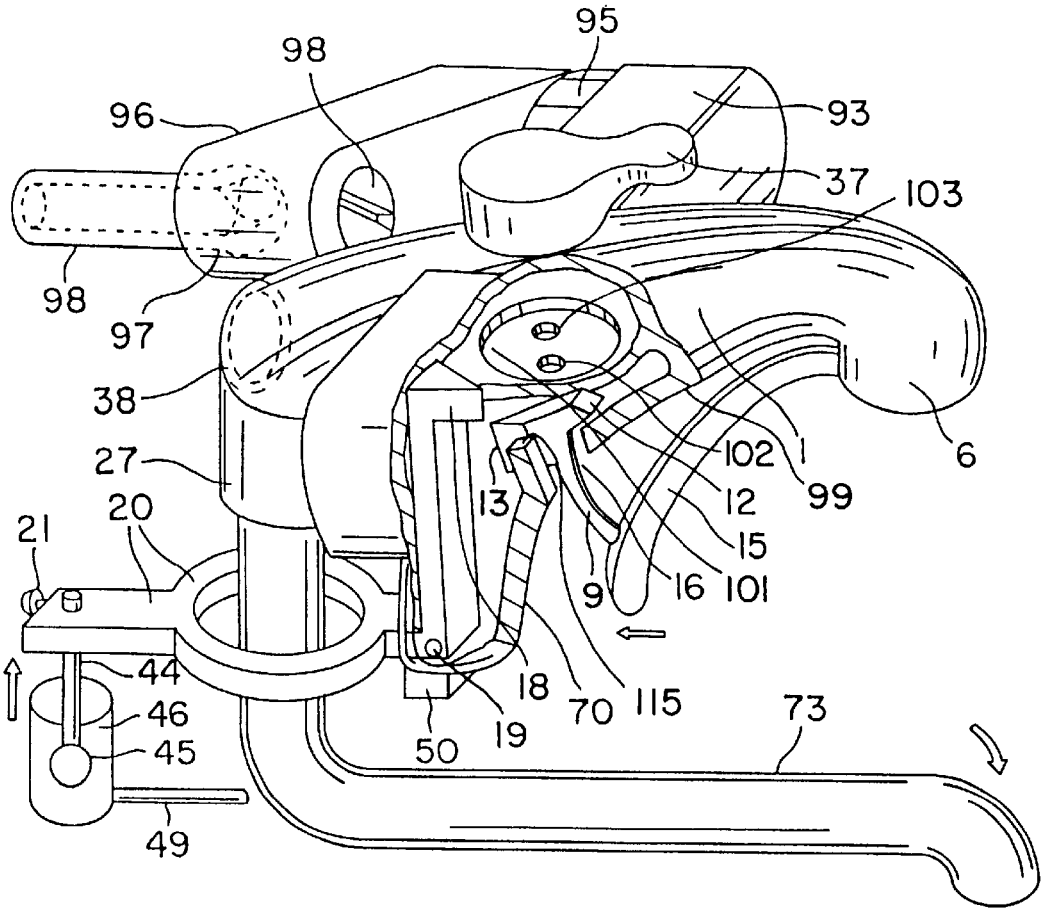

FIG. 3F shows the operation of the eccentric union 96 use for controlling the vertical position of the outlet port 6 of the tap. In order to adjust the position of the outlet port 6, the plug 114 is slightly loosened, with the water supply pipe 109 being positioned horizontally. Thereafter, the union 96 is pulled to a direction as shown by the arrow in the drawing prior to tightening the plug 114. Therefore, the top portion of the union 96 is leaned forward and makes the outlet port 6 move to its front and lower position.

Meanwhile, when the union 96 is pushed to the opposite direction prior to tightening the plug 114, the top portion of the union 96 is leaned back and makes the outlet port 6 move to its rear and upper position.

On the other hand, the position of the outlet port 6 may be controlled by adjusting the position of the second water supply pipe 118 relative to the union 96. That is, when the second water supply pipe 118 is pushed upwardly as shown by the arrow in FIG. 3F prior to tightening the plug 129, the outlet port 6 of the tap moves to its upper position. Meanwhile, when the second water supply pipe 118 is pulled to the opposite direction prior to tightening the plug 129, the outlet port 6 of the tap moves to its lower position. Therefore, it is possible to easily adjust the position of the outlet port 6 of the tap when necessary.

Industrial Applicability

As described above, the present invention provides a tap used for controlling the flow of liquid such as water, oil, or gas. The liquid control tap of this invention is provided with a valve, which is effectively operated using inexhaustible energy, such as gravity, hydraulic pressure, buoyancy, magnetic force, frictional force, or elasticity. In the tap of this invention, a connection pipe, which is used for the purpose of connecting the tap body to a separate device such as a shower device, is integrated with the rear portion of the tap body into a single structure, thus simplifying the construction of the tap and reducing the number of parts of the tap. Due to such a simple construction of the tap, the present invention simplifies the manufacturing process and improves productivity, and reduces the manufacturing cost of liquid flow control taps. The tap is also easily assembled, thus improving work efficiency while being assembled. The tap is freely operated to allow water to be instantaneously discharged prior to being stopped, to be continuously discharged prior to being manually stopped, or to be continuously discharged prior to being automatically stopped, thus being very convenient to users. The tap of this invention is also provided with an eccentric union for controlling the vertical position of the outlet port of the tap. Due to the union, the vertical position of the outlet port can be easily adjusted when necessary, thus being convenient to users. Another advantage of the tap of this invention resides in that the tap effectively prevents liquid loss, thus conserving liquid.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A liquid flow control tap, comprising:

a tap body having both a liquid outlet port and a lower opening and defining a liquid passage therein;

a hand lever movably engaging with said tap body in order to selectively open the outlet port, said hand lever including:

a handle and;

a hook block provided at one end of said handle and received into said lower opening of the tap body, said hook block being movably caught by a stop shoulder of the tap body and;

a valve operating end provided at the other end of the handle being interiorly seated on the outlet port of the tap body;

an outer-threaded member brought into engagement with the outlet port, thus holding the valve operating end of the lever in the outlet port of the tap body;

a spring-biased valve movably seated on an annular step provided in the liquid passage of the tap body, with a valve stem of the valve extending toward the outlet port and being seated on said valve operating end of the lever, said valve being selectively opened by the lever so as to discharge liquid from the outlet port;

a hollow cylindrical magnet arranged in the liquid passage of the tap body, with one end of the magnet being seated on said valve at a position opposite to the valve stem, said magnet being adapted for magnetizing the liquid prior to discharging the liquid from the outlet port;

a liquid junction member movably positioned on a hot and cold liquid inlet part of the liquid passage of the tap body, said junction member being adapted for mixing cold liquid with hot liquid into a mixed liquid while controlling the temperature of the mixed liquid;

a rotating shaft engaging with both said liquid junction member at the interior of the tap body and a rotatable handle at the exterior of the tap body, thus selectively rotating the junction member relative to the hot and cold liquid inlet part in accordance with a rotating motion of the rotatable handle while controlling the temperature of the mixed liquid;

a buoyancy-operable lever having a pushing part at one end thereof and interiorly hinged to said tap body by a pin in said opening of the tap body, said buoyancy-operable lever being adapted for selectively pushing the hook block of the hand lever so as to close the outlet port of the tap body;

a vertical push rod connected to both the other end of said buoyancy-operable lever at its upper end and a floating member at its lower end; and a liquid tank receiving said floating member therein and connected to a liquid bowl containing liquid discharged from the outlet port of the tap body, thus allowing the push rod with the floating member to selectively operate the buoyancy-operable lever in accordance with a liquid level in said liquid bowl.

2. The liquid flow control tap according to claim 1, further comprising:

a vertical pipe formed on the tap body at a position opposite to said outlet port and interiorly provided with an annular seat;

a second valve interiorly seated on the annular seat, with a valve stem of the second valve extending downwardly;

a vertical hose hinged to said vertical pipe through a set bolt and concentrically surrounding the valve stem of the second valve;

a first magnet mounted to the lower end of the valve stem of the second valve; and a second magnet mounted to said shielding member at a position suitable for allowing a first magnet to selectively and magnetically attract to the second magnet.

3. The liquid flow control tap according to claim 1, further comprising:

a horizontal pipe part formed in the rear portion of said tap body;

a valve housing horizontally installed in said horizontal pipe part, said valve housing having an interior annular seat; and a spring-biased second valve seated on said interior annular seat of the valve housing, with a valve stem of said second valve axially extending through the valve housing.

4. The liquid flow control tap according to claim 3, further comprising:

a rotatable bent pipe cooperating with said second valve so as to selectively discharge liquid from the tap body therethrough, said rotatable bent pipe having a U-shaped slit at the top end thereof and being upwardly and rotatably fitted into the rear portion of the tap body, with both the top end of the rotatable bent pipe being positioned in said valve housing and said U-shaped slit of the rotatable bent pipe being brought into engagement with the valve stem of the second valve, thus allowing the second valve being selectively opened in accordance with a rotating motion of the rotatable pipe.

5. The liquid flow control tap according to claim 3, further comprising:

a second vertical push rod upwardly and movably inserted into the rear portion of the tap body and cooperating with the valve stem of the second valve through cooperation means, said second push rod being hinged to a foot lever at its lower end, thus selectively opening said second valve in accordance with a levering motion of said foot lever;

an upper vertical pipe part formed on said tap body at a position above the horizontal pipe part and having an interior annular seat;

a connection pipe used for the purpose of connecting the tap body to a separate device, said connection pipe being vertically and downwardly fitted into said upper vertical pipe part with the lower end of said connection pipe being seated on the interior annular seat of the upper vertical pipe part; and a cap nut screwed onto said upper vertical pipe part, thus fixedly mounting said connection pipe to the tap body.

6. The liquid flow control tap according to claim 5, wherein said cooperation means comprises:

a first magnet mounted to said valve stem of the second valve; and a second magnet mounted to the top end of said second vertical push rod, thus selctively attracting said first magnet in accordance with a levering motion of said foot lever so as to open the second valve.

7. The liquid flow control tap according to claim 5, wherein said cooperation means comprises:

a transverse slot formed on the top end of said second vertical push rod and engaging with the valve stem of the second valve, thus allowing the second valve to be selectively opened in accordance with a levering motion of said foot lever.

8. The liquid flow control tap according to claim 1, further comprising:

a rotatable eccentric union provided on said tap body and adapted for controlling the vertical position of said outlet port of the tap body; and a liquid supply pipe rotatably connected to each end of said eccentric union through a ball joint, thus being selectively rotatable around the ball joint and allowing the vertical position of the outlet port of the tap body to be adjusted, said ball joint being formed by a ball part of the liquid supply pipe having a plurality of discharge ports and hexagonal ports.

* * * * *